US007832843B2

(12) United States Patent
Oikawa et al.

(10) Patent No.: US 7,832,843 B2
(45) Date of Patent: Nov. 16, 2010

(54) LIQUID JET HEAD

(75) Inventors: Masaki Oikawa, Inagi (JP); Mineo Kaneko, Tokyo (JP); Ken Tsuchii, Sagamihara (JP); Toru Yamane, Yokohama (JP); Keiji Tomizawa, Yokohama (JP); Mitsuhiro Matsumoto, Yokohama (JP); Shuichi Ide, Tokyo (JP); Kansui Takino, Kawasaki (JP); Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 587 days.

(21) Appl. No.: 11/844,071

(22) Filed: Aug. 23, 2007

(65) Prior Publication Data

US 2008/0055368 A1 Mar. 6, 2008

(30) Foreign Application Priority Data

Aug. 28, 2006 (JP) ..... 2006-230449

(51) Int. Cl.
*B41J 2/05* (2006.01)

(52) U.S. Cl. ..... 347/59; 347/20; 347/40; 347/48; 347/54; 347/56; 347/57; 347/58; 347/61; 347/62; 347/63; 347/65; 347/67

(58) Field of Classification Search ..... 347/58, 347/59, 62

See application file for complete search history.

(56) References Cited

U.S. PATENT DOCUMENTS

| | | | | |
|---|---|---|---|---|
| 5,218,376 | A | 6/1993 | Asai | |
| 6,155,673 | A | 12/2000 | Nakajima et al. | |
| 6,286,933 | B1 | 9/2001 | Murakami et al. | |
| 6,457,796 | B1 * | 10/2002 | Fujii | 347/12 |
| 6,652,079 | B2 | 11/2003 | Tsuchii et al. | |
| 6,799,822 | B2 * | 10/2004 | Cleland et al. | 347/12 |
| 6,830,317 | B2 | 12/2004 | Tsuchii et al. | |
| 6,984,025 | B2 | 1/2006 | Kaneko et al. | |
| 6,988,786 | B2 | 1/2006 | Kaneko et al. | |

(Continued)

FOREIGN PATENT DOCUMENTS

| | | |
|---|---|---|
| CN | 1254647 A | 5/2000 |
| EP | 0 999 050 | 5/2000 |
| EP | 1 555 125 | 7/2005 |
| JP | 61-185455 | 8/1986 |
| JP | 61-249768 | 11/1986 |

(Continued)

OTHER PUBLICATIONS

Translation of Shunka (JP 2001-277512), Oct. 2001.*

*Primary Examiner*—Ryan Lepisto
(74) *Attorney, Agent, or Firm*—Fitzpatrick, Cella, Harper & Scinto

(57) ABSTRACT

A liquid ejecting head includes plural ejection outlets for ejecting droplets; liquid flow paths in fluid communication with the ejection outlets; and a liquid supply opening for supplying the liquid to the liquid flow paths. The ejection outlets include first and second ejection outlets disposed at least at one side of the liquid supply opening and are staggered. The first ejection outlets are nearer to the liquid supply opening than the second ejection outlets. Each of first recording elements corresponding to the first ejection outlets includes one rectangular heat generating resistor having a long side extending along a direction crossing with an arranging direction of the ejection outlets. Each of second recording elements corresponding to the second ejection outlets comprises plural rectangular heat generating resistors which are adjacent to each other at long sides thereof and are electrically connected in series.

11 Claims, 12 Drawing Sheets

U.S. PATENT DOCUMENTS

| | | | | |
|---|---|---|---|---|
| 7,077,503 | B2 | 7/2006 | Kaneko et al. | |
| 7,125,099 | B2 | 10/2006 | Murakami et al. | |
| 7,431,434 | B2 * | 10/2008 | Agarwal et al. | 347/65 |
| 2002/0109753 | A1 | 8/2002 | Leu et al. | |
| 2004/0145633 | A1 * | 7/2004 | Lim et al. | 347/62 |
| 2006/0139413 | A1 | 6/2006 | Oikawa | |
| 2007/0206065 | A1 | 9/2007 | Tomizawa et al. | |
| 2008/0001994 | A1 | 1/2008 | Kaneko | |
| 2008/0136872 | A1 | 6/2008 | Tsuchii et al. | |
| 2008/0143786 | A1 | 6/2008 | Oikawa et al. | |

FOREIGN PATENT DOCUMENTS

| | | | |
|---|---|---|---|
| JP | 4-10940 | | 1/1992 |
| JP | 4-10941 | | 1/1992 |
| JP | 2001-277512 | * | 10/2001 |
| JP | 2004050484 | A | 2/2004 |
| JP | 2005001238 | A | 1/2005 |
| TW | I232802 | B | 5/2005 |
| TW | I236973 | B | 8/2005 |
| WO | 2006/051762 | | 5/2006 |

* cited by examiner

LIQUID JET HEAD

FIELD OF THE INVENTION AND RELATED ART

The present invention relates to a liquid jetting head for recording on recording medium by jetting ink onto the recording medium.

In recent years, various recording apparatuses have come to be widely used, and at the same time, demand has been increasing for image forming apparatuses which are significantly higher in recording speed, resolution, and image quality, but, are significantly lower in noise than any of the recording apparatuses in accordance with the prior art. As one of the recording apparatuses which can meet these demands, an ink jet recording apparatus may be listed.

Among various methods for jetting ink, an ink jetting method which employs an electro-thermal transducer as an energy generating element enjoys various a advantages over the other types of ink jetting methods. For example, it does not require a large space for the energy generating elements and is simple in structure. Further, it allows a large number of nozzles to be arranged in high density. On the other hand, it has its own problems. For example, the heat which the electro-thermal transducers generate accumulates in the recording head, changing thereby the recording head in the volume (size) of an ink droplet the recording head ejects, or the electro-thermal transducers are adversely affected by the cavitation attributable to the collapsing of bubbles. Further, in the case of a recording head which employs the abovementioned ink jetting method, the air having dissolved into ink forms air bubbles in the recording head, and these air bubbles adversely affect the recording head in ink jetting performance and image quality.

Some of the methods for solving these problems are described in Japanese Laid-open Patent Applications S61-185455, S61-249768, and H04-10941.

The employment of the above described ink jet recording method makes it possible to stabilize a recording apparatus in ink droplet volume, and also, to jet extremely small ink droplets at a very high velocity. Further, the employment of the above described ink jet recording method makes it possible to prevent the cavitation attributable to the collapsing of bubbles, making it therefore possible to extend the life of the heater. It also makes it possible to easily obtain a significantly more precise image than an image formed with the use of an ink jet recording apparatus which employs a recording method other than the above described one. As the structural arrangement for releasing bubbles into the ambient air, the published patent applications mentioned above describe the structural arrangement which is substantially smaller in the distance between an electro-thermal transducer for generating bubbles in ink and the corresponding ink jetting orifice, or the hole, through which ink is jetted, compared to that in an ink jet recording head in accordance with the prior art.

Further, as one of the means for enabling an ink jet recording apparatus to form an image which does not appear grainy, it has been proposed to provide an ink jet recording head with two sets of nozzles, which are the same in the color of the ink they jet, but, are different in color density. Thus, some of the conventional ink jet recording heads are provided with two sets of nozzles, which are the same in the color of the ink they jet, but, are different in the color density.

However, this structural arrangement requires two ink containers per color, that is, one ink container for the ink lighter in color, and the other for the ink darker in color, adding thereby to apparatus cost. Thus, the following combination of structural arrangement and recording method has been proposed as one of the solutions to the abovementioned problem: An ink jet recording head is provided with two or more sets of nozzles per color, which are different in ink droplet size, and the portions of an image, which are low to middle in tone, are formed of ink dots formed by relatively small ink droplets, whereas the portions of the image, which are middle to dark in tone, are formed of ink dots formed by relatively large ink droplets.

This solution also suffers from a problem. That is, in the case of an ink jet recording head provided with two sets of nozzles, which are different in the diameter of their liquid (ink) jetting orifices, if both sets of nozzles are reduced in the diameter of their ink jetting orifices to further reduce the nozzles (ink jet recording head) in ink droplet size, it becomes impossible to deposit a desired amount of ink per unit area of recording medium, unless the ink jet recording head is changed in the resolution in terms of the direction of the rows of nozzle orifices. As a method for increasing the amount by which liquid (ink) is deposited per unit area on a recording medium, it is possible to increase the resolution in terms of the direction in which a recording head is moved in a manner to scan the recording medium. In the case of this method, however, a recording head must be increased in ink jetting frequency, or it must be reduced in moving speed. There has also been proposed to increase the amount by which liquid (ink) is deposited per unit area on the recording medium by multiple passes, that is, by increasing the number of times a recording head is moved across the recording medium per scanning line. This method also results in the reduction in printing speed, because the increase in the number of times a recording head is moved across the recording medium per scanning increases the length of time it takes to complete a portion of an image, which corresponds to each scanning line. Thus, as an ink jet recording head is reduced in ink droplet size, it needs to be increased in the resolution in terms of the direction in which its ink jetting orifices are aligned. However, this method also has its limitation. That is, it has been well known that reducing an ink jet recording head in ink droplet size reduces the ink jet head in printing efficiency, and also, that increasing an ink jet recording head in resolution by reducing it in ink droplet size (ink jetting orifice size) makes its heaters disproportionally large for the number of its ink jetting orifices per unit area, making it thereby difficult to thread (route) heater wiring. Thus, an attempt to increase an ink jet recording head in resolution beyond a certain value makes it impossible to arrange the heaters of the recording head in a straight line. This problem is not limited to the heater arrangement; the passages through which ink is supplied suffer from the same problem.

As one of the solutions to the above described problem, it has been known to stagger heaters 4000 as shown in FIG. 12. In the case of this structural arrangement, one row of nozzles may be different in dot diameter from the other, or the two rows of nozzles may be the same in dot diameter.

Schematically shown in FIG. 12 are the nozzles 1000 in a part of an example of a high resolution ink jet recording head. Referring to FIG. 12, the nozzle measurement will be described in detail. The ink jet recording head is provided with a set of short nozzles and a set of long nozzles, which are positioned so that the short nozzles and long nozzles are alternately positioned, in terms of the direction parallel to the common ink delivery channel 5000. In each set of nozzles 1000, the nozzles are positioned so that their ink jetting orifices align in a straight line parallel to the common ink delivery channel 5000. Further, the two nozzle rows are positioned so that the row of the ink jetting orifices of the short nozzles is closer to the common ink delivery channel 5000 than the row of the ink jetting orifices of the long nozzles. Moreover, the two nozzle rows are positioned so that the ink jetting orifices are staggered in the direction parallel to the lengthwise direction of the common ink delivery channel 5000. Also in terms of the direction parallel to the lengthwise direction of the common ink delivery channel 5000, the ink jetting orifice pitch of the set of long nozzles and that of the set of short nozzles are both 600 orifices per inch (42.5 μm in interval). The external measurement of each heater 4000 is 13 μm×26 μm. For the reasons given above, and also, for the reason related to the manufacturing of an ink jet recording head chip, the nozzle wall was formed to be roughly 8 μm in thickness. The narrower portion of the ink passage 3000 of each long nozzle is roughly 10 μm in dimension in terms of the direction parallel to the long edges of the common ink delivery channel 5000.

However, this structural arrangement also has problems. First, the heater of a long nozzle is positioned farther from the ink delivery channel 5000 than the heater of a short nozzle. Therefore, even if the heater 4000 of each short nozzle is made rectangular to allow the ink passage 3000 of the adjacent long nozzle to be wider, the problem that the refill frequency is not high enough for satisfactory image formation cannot be completely eliminated.

Secondly, the employment of a rectangular heater 4000 creates a dead zone, that is, the area which is difficult for ink to flow into, in the portion of the pressure chamber 2000, which is on the opposite side of the heater 4000 from the common ink delivery channel 5000. Further, it has been known that the abovementioned air bubbles are likely to collect in this dead zone, and also, the collection of air bubbles in a nozzle makes the nozzle unstable in ink jetting performance, making therefore an ink jet recording head unstable in ink jetting performance. It has also been known that the smaller (no more than roughly several pl) the liquid (ink) droplet, the more conspicuous the unstableness attributable to this dead zone.

The third problem is the increase in the manufacturing cost of an ink jet recording head chip, which results from the increase in size of the portion of the recording head having multiple nozzles. More specifically, nowadays, the substrate of an ink jet recording head, on which heaters are placed, is a part of a large wafer of a specific substance. Therefore, the greater the chip size, the smaller the number of ink jet recording head chips obtainable from a single wafer, and therefore, the higher the manufacturing cost of each ink jet recording head chip. Further, in the case of the ink jet recording head chip structured as shown in FIG. 12, not only are the heaters rectangular, but also, the heater in each of the long nozzles is located farther from the common ink delivery channel than in the case of an ink jet recording head chip whose heaters are arranged in a single row. Therefore, the substrate of the nozzle plate structured as shown in FIG. 12 has to be greater in size, being therefore greater in manufacturing cost.

As one of the means for solving the above described problems, it has been proposed to change the shape for the heater for a long nozzle from a rectangular shape to a square shape.

However, making the heater in a short nozzle and the heater in a long nozzle different in shape makes the former and the latter different in electrical resistance. Thus, if they are the same in the length of time electric current flows through them (same in driving pulse width), an image forming apparatus must be provided with two power sources for driving the heaters, which are different in power (voltage), or a circuit for making the voltage applied to the former different in magnitude from the voltage applied to the latter, increasing thereby the cost of manufacturing the power source. This is the fourth problem.

It is possible to make the pulses applied to the former different in width from the pulses applied to the latter. However, this method was also problematic in that it sometimes prevented heater driving pulses from reaching the heaters within the length of time tolerable based on printing speed, and also, created the problem that not only was the heater which received long pulses inferior in bubble generation efficiency to the heater which received short pulses, but also, was different in the pattern of heat flux from the heater which received short pulses, making the ink jet recording head unstable in ink jetting performance. It has been known that the smaller the liquid droplet (ink droplet) in volume (roughly several pico-liters), the more conspicuous the problem (ink jet recording head is unstable in ink jetting performance).

SUMMARY OF THE INVENTION

Thus, the primary object of the present invention is to provide a liquid jetting head in which its nozzles are arranged with a significantly higher pitch than in an ink jet recording head in accordance with the prior art, and which therefore is significantly higher in image quality than a liquid jetting head in accordance with the prior art, without increasing the cost of the ink jet recording head chip, without increasing the manufacturing cost for the chip driving power source, without exacerbating the poor bubble generation efficiency attributable to long pulses, and also, without making a liquid jetting head chip unstable in liquid jetting performance. Another object of the present invention is to provide a liquid jetting head, the liquid jetting nozzles of which are significantly small in liquid droplet size than any of liquid jetting heads in accordance with the prior art.

According to an aspect of the present invention, there is provided liquid ejecting head comprising a plurality of ejection outlets for ejecting droplets; liquid flow paths in fluid communication with said ejection outlets; a liquid supply opening for supplying the liquid to said liquid flow path; wherein said ejection outlets include first ejection outlets and second ejection outlets which are disposed at least at one side of said liquid supply opening, wherein said first ejection outlets are nearer from said liquid supply opening than said second ejection outlets, and said first ejection outlets and said second ejection outlets are arranged in a staggered fashion; first recording elements for said first ejection outlets; and second recording elements for said second ejection outlets; wherein each of said first recording elements includes one heat generating resistor in the form of a rectangular shape having a long side extending along a direction crossing with an arranging direction of said ejection outlets; wherein said second recording element includes a plurality of heat generating resistors each of which is in the form of a rectangular shape and which are adjacent to each other at the long sides thereof, said plurality of heat generating resistors being electrically connected in series.

According to the present invention, it is possible to achieve a high level of image quality without increasing ink jet recording head chip cost, without increasing the manufacturing cost for the chip driving power source, without exacerbating the poor bubble generation efficiency attributable to long pulses, and also, without making a liquid jetting head chip unstable in liquid jetting performance.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be concretely described in detail with reference to the appended drawings.

Figure 1:
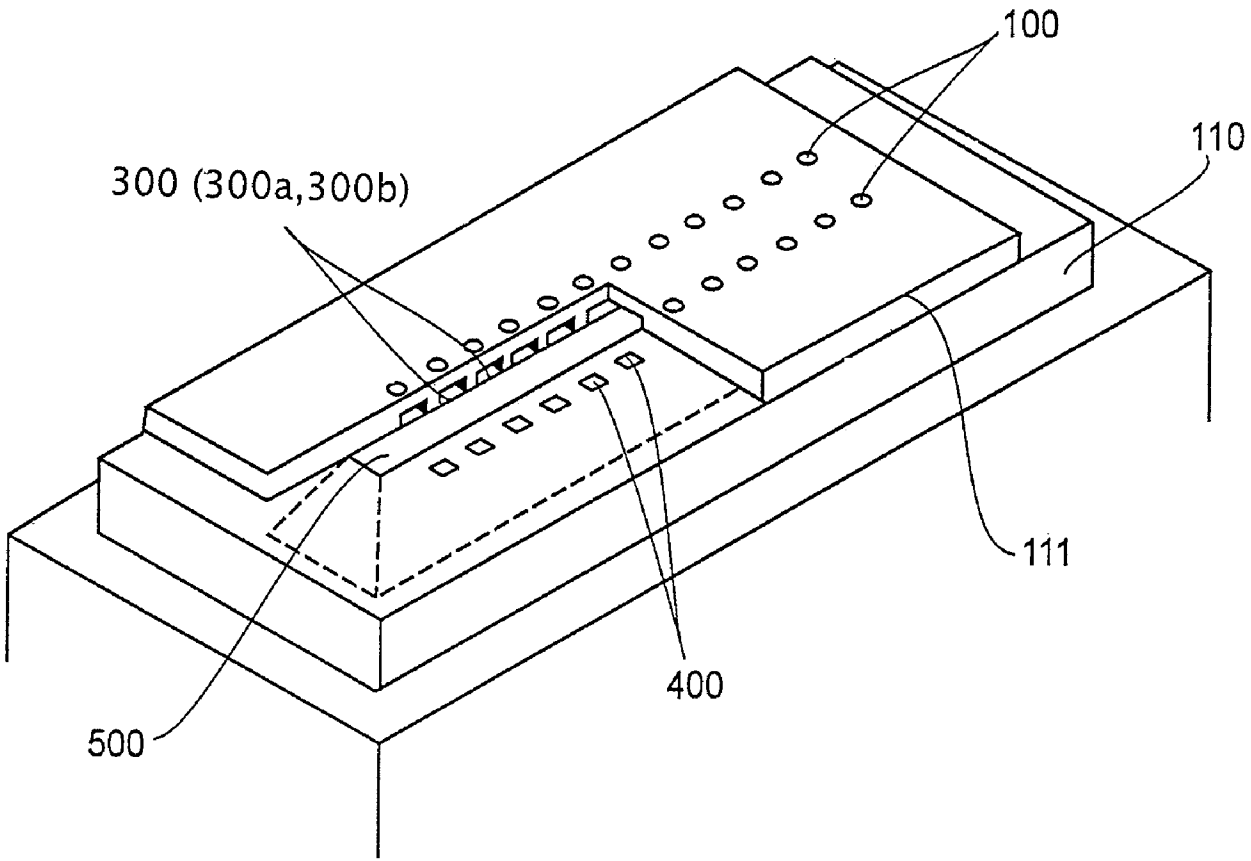
FIG. 1 is a partially cutaway perspective view of the ink jet recording head in the first preferred embodiment of the present invention.

First, the general structure of the ink jet recording head in accordance with the present invention will be described. FIG. 1 is a partially cutaway perspective view of the ink jet recording head in the first preferred embodiment of the present invention. Referring to FIG. 1, the ink jet recording head in this embodiment of the present invention is provided with multiple electro-thermal transducers 400 (heaters), a substrate 110, and a nozzle plate 111. The electro-thermal transducers 400 constitute the recording elements. They are on the substrate 110. The nozzle plate 111 provides the ink jet recording head with multiple liquid passages, as multiple ink passages, by being layered on the surface of the substrate having the electro-thermal transducers 400.

The substrate 110 is formed of glass, ceramic, resinous substance, metallic substance, etc., for example. Ordinarily, it is formed of silicon. On the primary surface of the substrate 110, heaters 400, electrodes (unshown) for applying voltage to the heaters 400, and wiring (unshown), are located. There is one heater for each ink passage. The wiring is patterned to match the placement of the heaters 400 and electrodes. Also located on the primary surface of the substrate 110 is a film (unshown) of a dielectric substance, which is for improving the ink jet recording head chip in heat dispersion. The film of the dielectric substance is placed in a manner to cover the heaters 400. Further, the ink jet recording head chip is provided with a protective film (unshown) for preventing the primary surface of the substrate 110 from being subjected to the cavitation, that is, the rapid growth or collapse of bubbles (vapor pockets). The protective film is placed in a manner to cover the dielectric film.

Referring to FIG. 1, the nozzle plate 111 is provided with multiple ink passages 300 (nozzles) through which ink flows, and a common ink delivery channel 500 (liquid delivery channel) for supplying these nozzles 300 with ink. The common ink delivery channel 500 (which hereafter may be referred to simply as ink delivery channel 500) extends in the direction parallel to the orifice rows. The nozzle plate 111 is also provided with multiple ink jetting orifices 100, each of which constitutes the outward end portion of the corresponding nozzle 300, through which ink droplets are jetted. In terms of the direction perpendicular to the primary surface of the substrate 110, each ink jetting orifice 100 is in alignment with the corresponding heater 400, which is virtually flat.

In other words, there are multiple heaters 400 and multiple nozzles 300 on the surface of the substrate 110. There are two sets of nozzles 300, that is, a set of short nozzles 300 and a set of long nozzles 300. The short and long nozzles 300 are perpendicular to the common liquid delivery channel 500, being therefore parallel to each other, and are juxtaposed in parallel in the direction parallel to the common ink delivery channel 500 (which hereafter may be referred to as lengthwise direction), so that the orifices of short nozzles 300 form a single row (first row) parallel to the lengthwise direction, and the orifices of long nozzles also form a single row (second row) parallel to the lengthwise direction; the liquid (ink) jetting orifices form two rows parallel to the lengthwise direction. Further, the nozzle pitch of the first row of nozzles is equivalent to 600 dpi or 1,200 dpi, and so is the nozzle pitch of the second row of nozzles. For the reason related to dot placement, the two nozzle rows are positioned so that the ink jetting orifices of the nozzles in the second row are offset in the lengthwise direction from the corresponding ink jetting orifices of the nozzles in the first row.

The ink jet recording head structured as described above has an ink jetting means compatible with the ink jet recording method disclosed in Japanese Laid-open Patent Applications H04-10940 and H04-10941. Some ink jet recording heads similar to this ink jet recording head are structured so that the air bubbles generated when ink is jetted are allowed to escape into the ambient air through the ink jetting orifices.

Hereinafter, the typical nozzle structure of an ink jet recording head chip in accordance with the present invention, and its variations, will be described.

Embodiment 1

Figure 2:
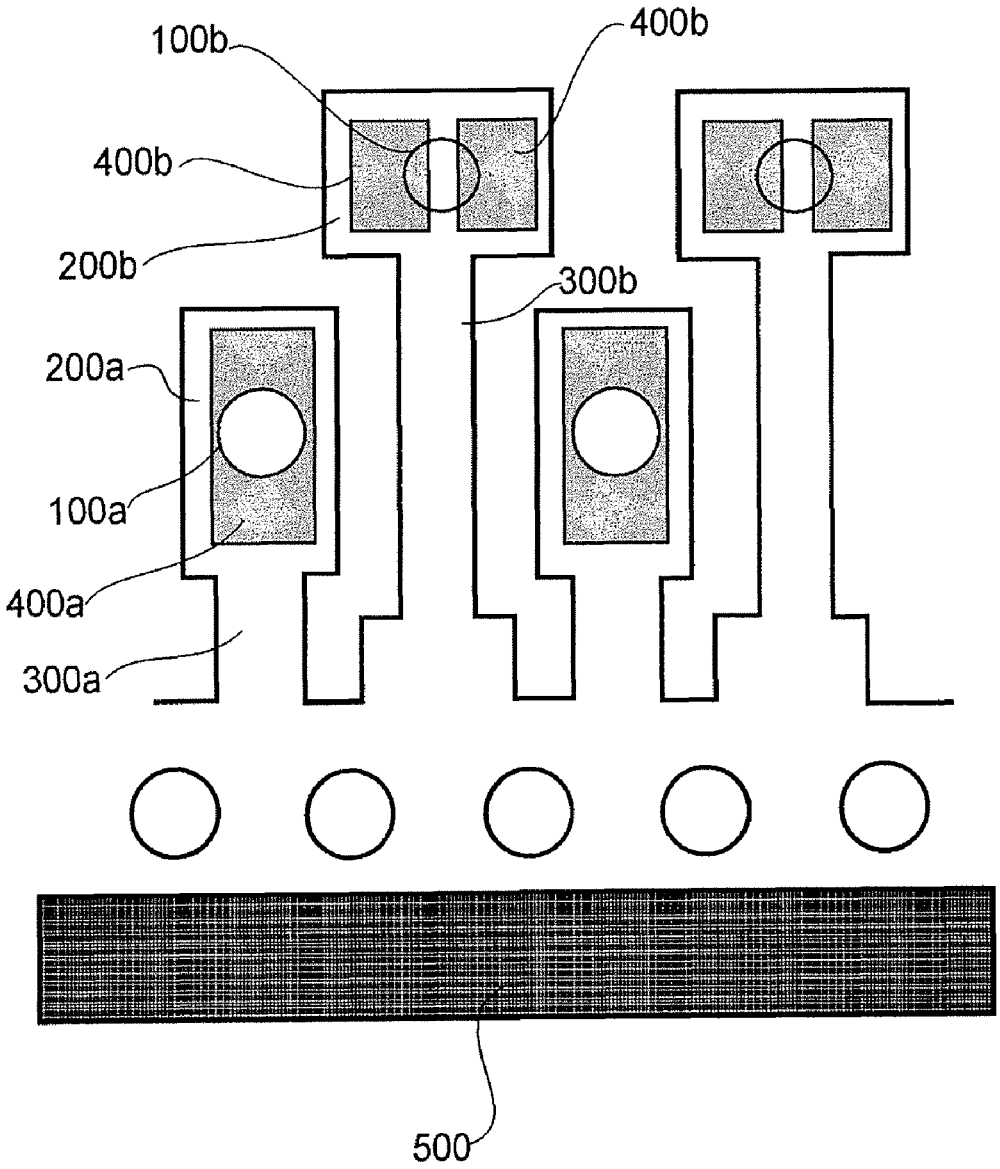
FIG. 2 is a schematic drawing of the nozzles in a part of the ink jet recording head in the first preferred embodiment.

FIG. 2 shows the nozzle structure of the ink jet recording head in the first preferred embodiment of the present invention. In the following description of this embodiment, the structure of the ink jet recording head is described with reference to the portion of the ink jet recording head on one side of the common ink delivery channel 500. This, however, is not intended to limit the present invention in scope. That is, the other side of the common ink delivery channel 500 may also be provided with sets of nozzles similar to the groups of nozzles which will be described next. One end of a first liquid passage 300*a* and one end of a second liquid passage 300*b* are in connection with a pressure chamber 200*a* and a pressure chamber 200*b*, respectively, whereas the other end of the first liquid passage 300*a* and the other end of the second liquid passage 300*b* are in connection to the common ink delivery channel 500. Referring to FIG. 2, the ink jet recording head in this embodiment has multiple first liquid (ink) jetting orifices 100*a* (which hereafter may be referred to simply as orifices 100*a*), and multiple second liquid (ink) jetting orifices 100*b* (which hereafter may be referred to simply as orifices 100*b*). The distance from each orifice 100*a* to the common liquid delivery channel 500 is shorter than the distance from each orifice 100*b* to the common liquid delivery channel 500. The ink jet recording head is structured so that the first orifices 100*a* align in a single row parallel to the lengthwise direction (of the common liquid delivery channel 500), and the second orifices 100*b* also align in a single row parallel to the lengthwise direction, and also, so that in terms of the lengthwise direction, the first and second orifices 100*a* and 100*b* are alternately positioned; the ink jet orifices 100 are positioned in a zigzag pattern (staggered). Moreover, the ink jet recording head in this embodiment is provided with first heaters 400*a* and second heaters 400*b*. The first heaters 400*a* are positioned to oppose the first ink jetting orifices 100*a*, one for one, and the second heaters 400*b* are positioned to oppose the second ink jetting orifices 100*b*, one for one.

Next, referring to FIG. 2, the specification of the ink jet recording head in this embodiment will be described. In terms of the nozzle row direction, the orifice pitch of the row of long nozzles and the orifice pitch of the row of short nozzles are 600 orifices per inch (42.3 μm in interval). Thus, the overall orifice pitch (which is equivalent to image resolution—dpi) of the ink jet recording head is 1,200 orifices per inch. Incidentally, the ink jet recording head is also provided with another set of rows of ink jetting orifices 100, which is on the opposite side of the common ink delivery channel 500 from the first set, and the orifices 100 of this set are offset in the lengthwise direction from the corresponding orifices 100 in the first set. Thus, the ink jet recording head in this embodiment can achieve a resolution as high as 2,400 dpi. A first heater 400*a* (first recording element), which is relatively small in the distance from the common ink delivery channel 500, is rectangular, and is 13 μm×26 μm in measurement.

A first orifice 100*a* which is relatively small in the distance from the common ink delivery channel 500, is 10 μm-15 μm in diameter. The ink jet recording head is structured so that the lengthwise direction of each first heater 400*a* is parallel to the direction in which the orifices 100 are aligned in each orifice row, as shown in FIG. 2.

As for the measurements of an ink passage 300*b*, that is, an ink passage which is relatively long, the portion of the ink passage 300*b*, which is between the adjacent two first heaters 400*a*, is smaller in width than the actual heat generating resistor portion of the first heater 400*a*, in terms of the direction parallel to the long edges of the common ink delivery channel 500.

A second heater 400*b* (second recording element), that is, a heater which is relatively large in the distance from the common ink delivery channel 500, is made up of two heat generating resistors, which are rectangular and are 9.5 μm×13.5 μm in measurement. The two resistors are connected in series. They are juxtaposed in parallel so that one of the long edges of one of the resistors faces one of the long edges of the other resistor. The distance between the two resistors is roughly 2 μm—4 μm. An orifice 100*b*, that is, an orifice which is relatively large in the distance from the common ink delivery channel 500, is roughly 5 μm-10 μm in diameter. In the case of the ink jet recording head in this embodiment, various levels of tone are achieved by changing dot size, and the dot size is changed by changing in size the liquid droplets jetted from the first and second orifices 100*a* and 100*b*. Thus, for the purpose of achieving various levels of tone, not only is the first orifice 100*a* made different in diameter from the second orifice 100*b*, but also, the first heater 400*a* is made different in size from the second heater 400*b*.

The clearance between the wall of the pressure chamber 200*a* and the heater 400*a*, and the clearance between the wall of the pressure chamber 200*b* and the heater 400*b*, are roughly 2 μm. The distance from the common ink delivery channel 500 to a first heater 400*a* is 44 μm, being therefore relatively short, and the distance between the center of a first heater 400*a* and the center of the adjacent second heater 400*b* is 35 μm-45 μm.

As described above, the ink passage 300*b*, that is, the ink passage of a long nozzle in this embodiment, is shorter than that in accordance with the prior art. Therefore, the first problem, that is, the problem concerning the refill time, is minimized. That is, the refill time of the ink jet recording head in this embodiment is significantly shorter than that of an ink jet recording head in accordance with the prior art. Therefore, the ink jet recording head in this embodiment can print at a significantly greater speed than an ink jet recording head in accordance with the prior art. As for the second problem, that is, the problem concerning the dead zone, that is, the area (zone) in which ink is likely to become stagnant, and which occurs in the opposite portion of the pressure chamber from the common ink delivery channel 500, the dead zone which occurs in the ink jet recording head in this embodiment is significantly smaller than the dead zone which occurs in an ink jet recording head in accordance with the prior art. Therefore, the ink jet recording head in this embodiment does not suffer from the problem that an ink jet recording head is made unstable in liquid (ink) jetting performance by the air bubbles in the nozzle.

Also as described above, the lengthwise measurement of a heater 400*a*, that is, the heater 400 which is relatively small in the distance from the common ink delivery channel 500, is roughly twice that of a heater 400*b*, that is, the heater 400 which is relatively large in the distance from the common ink delivery channel 500. This arrangement makes the first and second heaters 400*a* and 400*b* equal in electrical resistance, making it therefore possible to drive both the first and second heaters 400*a* and 400*b* with the use of a single common electric power source; an additional electric power source for driving heaters 400 is unnecessary. Thus, the ink jet recording head in this embodiment does not suffer from the fourth problem, that is, the problem concerning the increase in the cost for manufacturing the electric power source. In other words, this preferred embodiment is effective to reduce the manufacturing cost of an ink jet recording head.

Figure 5:
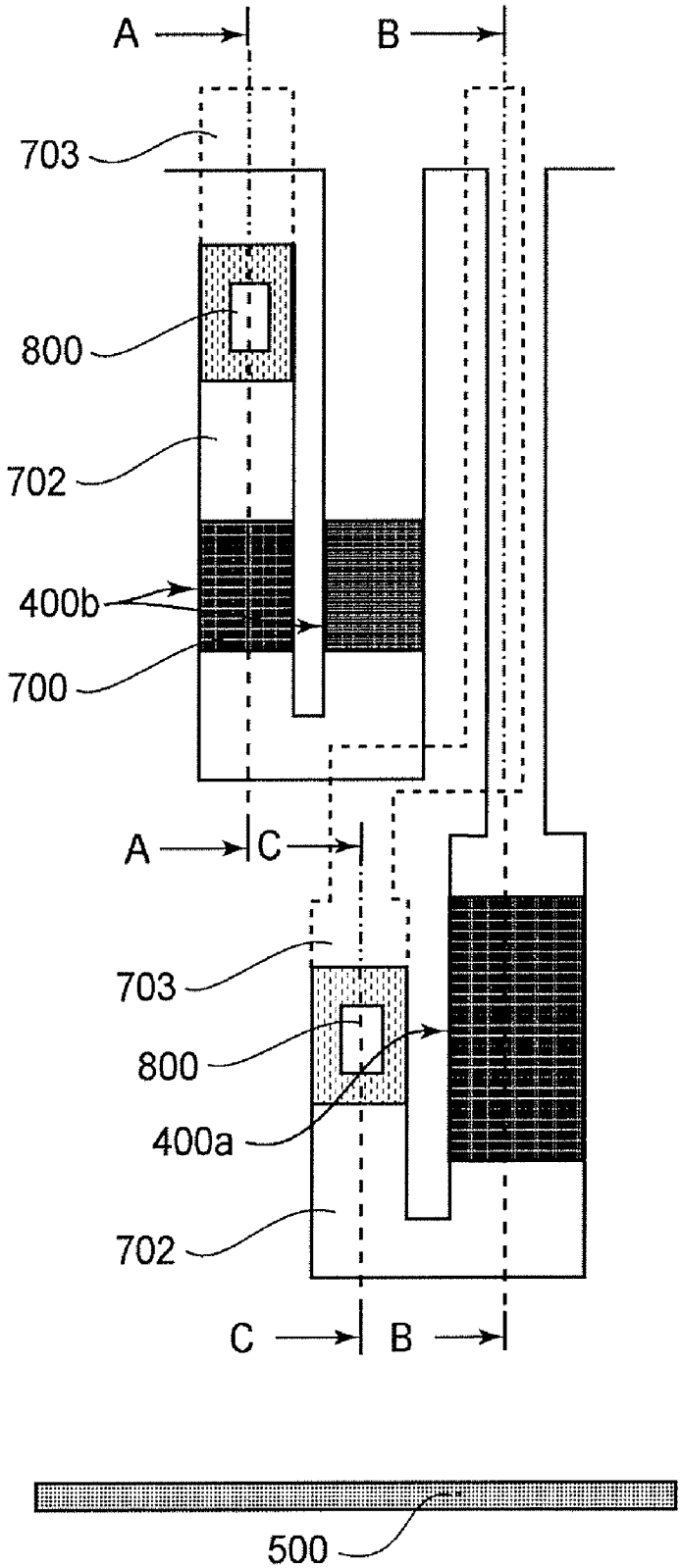
FIG. 5 is a schematic drawing of the wiring for the first and second heaters of the ink jet recording head in the first preferred embodiment.
Figure 8:
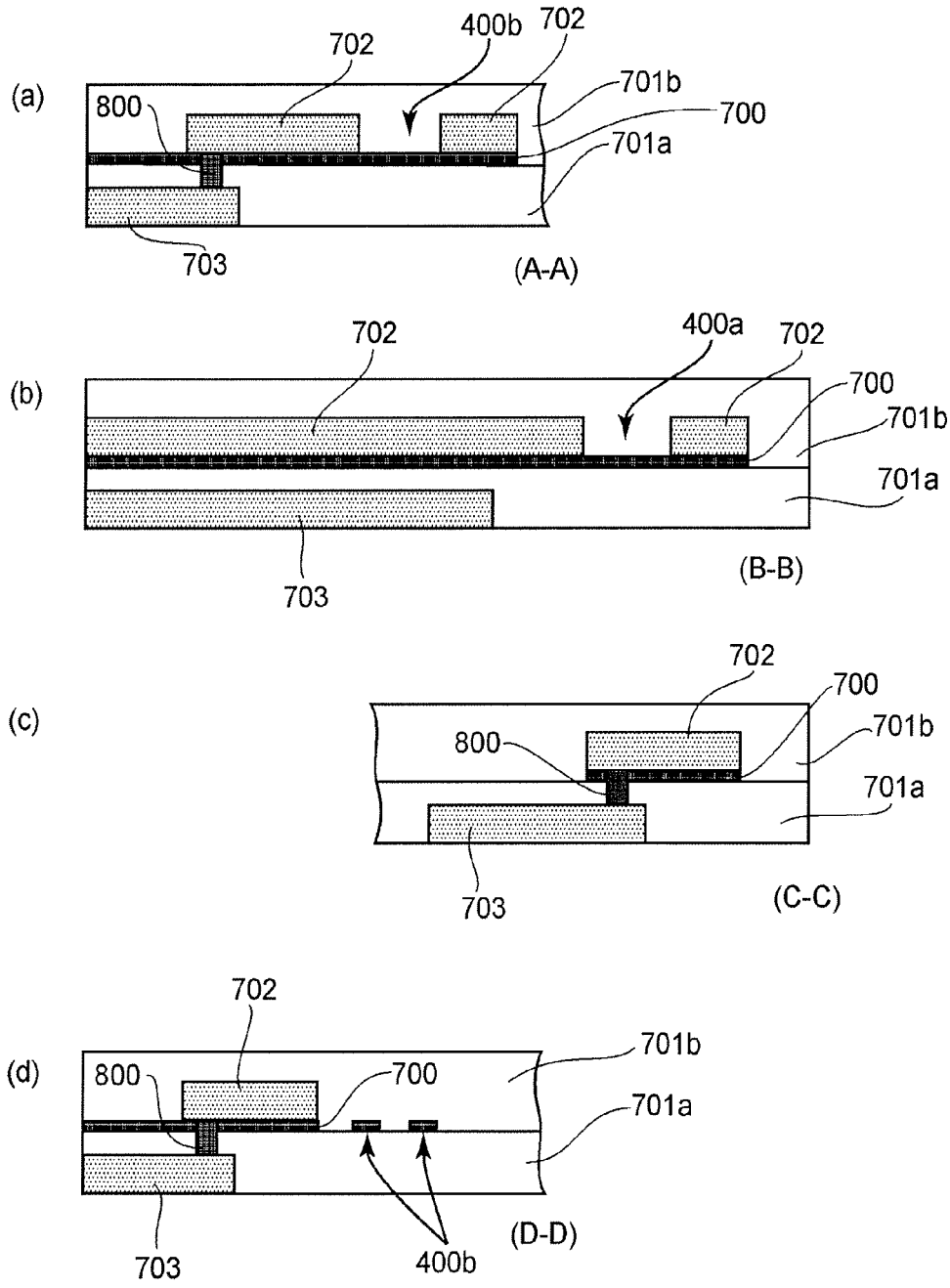
FIG. 8 is schematic sectional view of the ink jet recording head chips in the first to third preferred embodiments, respectively.

FIG. 5 is a schematic drawing of the wiring for the first and second heaters 400*a* and 400*b*, on the substrate of the ink jet recording head chip in this embodiment. FIGS. 8(*a*), 8(*b*), and 8(*c*), which are sectional views of the ink jet recording head chip in this embodiment, correspond to lines A-A, B-B, and C-C, respectively, in FIG. 5.

Referring to FIGS. 5, and 8(*a*)-8(*c*), the structure of the ink jet recording head chip will be described from the bottom layer side. The ink jet recording head chip is provided with a substrate, and multiple functional layers layered on the substrate. The functional layers are a first wiring layer 703, an insulation layer 701*a*, a heater layer 700, a second wiring layer 702, and an insulation layer 701*b*, which are formed in the listed order on the substrate. Further, the chip is provided with multiple through holes 800, each of which extends from the first wiring layer 703 to the second wiring layer 702, through the first insulation layer 701*a* and heater layer 700. The first and second wiring layers 703 and 702 are in electrical connection with each other through the through hole 800. The first and second wiring layers 703 and 702, and heater layer 700 are entirely covered with the insulation layers 701*a* and 701*b*, except for the through holes 800.

A first heater 400*a*, or the heater which is relatively small in the distance from the common ink delivery channel 500, is in electrical connection with the first and second wiring layers 703 and 702, which are the top and bottom wiring layers, respectively, through the through hole 800 provided next to the heater 400*a*.

Referring to FIG. 5, the portions of the heater layer 700, on which the first and second wiring layers 703 and 702 are not present, correspond to the first and second heaters 400*a* and 400*b*. The first heater 400*a* and second heater 400*b* are in electrical connection with the wiring by one of their short edges.

Referring to FIGS. 8(*a*) and 8(*b*), there is no second wiring layer 702 directly below the first and second heaters 400*a* and 400*b*, making it unlikely for the heat dispersion, and the stepped portion of the nozzle plate attributable to the stepped portions of the substrate, to have adverse effects. Further, the through hole 800 is located in the adjacencies of the heater 400*a* and heater 400*b*, and therefore, the chip is superior in area utilization efficiency than a chip in accordance with the prior art. Further, the through hole 800 is located at the mid point between the adjacent two heaters 400*a*, making it unlikely for the stepped portions of the nozzle plate attributable to the through holes 800 to have adverse effects.

As described above, by employing the above described structural arrangement, it is possible to more efficiently lay out the abovementioned elements and portions on the substrate from the standpoint of area (space) utilization, making it possible to solve the third problem, that is, the increase in the manufacturing cost attributable to substrate size.

Figure 9:
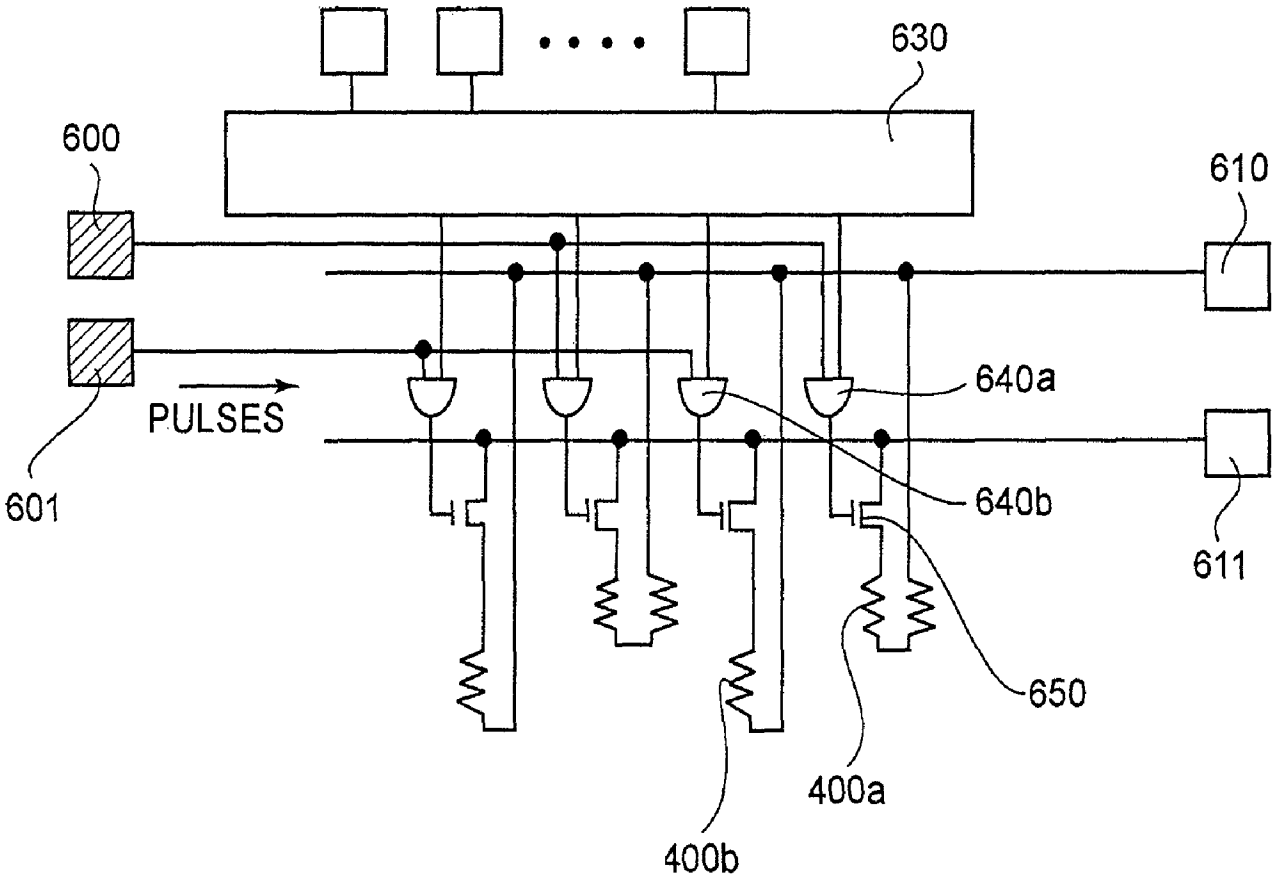
FIG. 9 is a drawing of the circuit related to the driving of the recording elements of the ink jet recording head chips in the first-third preferred embodiments.

FIG. 9 is a circuit diagram of the ink jet recording head chip in this embodiment. A control block 630, which controls the processing of various data and the process of sequentially driving the recording elements, selects the heaters 400*a* and 400*b* which are to be driven based on the inputted print data. The electric power supplying element 610, which is for supplying the voltage for driving the heaters 400*a* and 400*b*, and a GND terminal 611, are shared by the heaters 400*a* and heaters 400*b*, because the voltage for driving the heaters 400*a* and the voltage for driving the heaters 400*b* are the same in magnitude.

Driving time determination signal terminals 600 and 601 set up the length of time electric current is to be flowed through the heaters 400*a* and 400*b* (length of time heaters 400*a* and 400*b* are to be driven). In this embodiment, two driving systems are provided, that is, one for driving the heaters 400*a* and another for driving the heaters 400*b*. However, a single driving system may be shared by the heaters 400*a* and 400*b*. The control circuit is designed so that the combination of a power transistor 650 and a pair of AND circuits 640*a* and 640*b* can selectively drive the heaters 400*a* and 400*b* with proper timing and for a proper length of time in order to jet liquid (ink) droplets with proper timing.

As described above, this embodiment can achieve a significantly higher level of image quality without increasing the ink jet recording head chip in manufacturing cost, without increasing the heater driving power source in manufacturing cost, without exacerbating the reduction in the bubble generation efficiency attributable to long pulses, and also, without making unstable the ink jet recording head in liquid (ink) jetting performance. Another object of the present invention is to realize an ink jet recording head chip having a row of nozzles which are substantially smaller in liquid droplet size than the nozzles which an ink jet recording head chip in accordance with the prior art has.

Further, in this embodiment, the wiring for providing the first heaters with electric power is formed in two layers. Therefore, the ink jet recording head chip in this embodiment is substantially higher in spatial efficiency in terms of the layout of the heaters and the wiring therefor. Moreover, the through holes are placed in the adjacencies of the heaters, and therefore, the ink jet recording head chip in this embodiment is even greater in spatial efficiency in terms of component layout. In addition, the effects of the stepped portions of the nozzle portion attributable to the stepped portions of the substrate are minimum. Further, regarding the second recording element described above, which has two heat generating resistors, the sum of the length of the short edge of one of the two resistors, the length of the short edge of the other resistor, and the gap between the two resistors, is no less than half the distance between the adjacent two second orifices.

Embodiment 2

Figure 3:
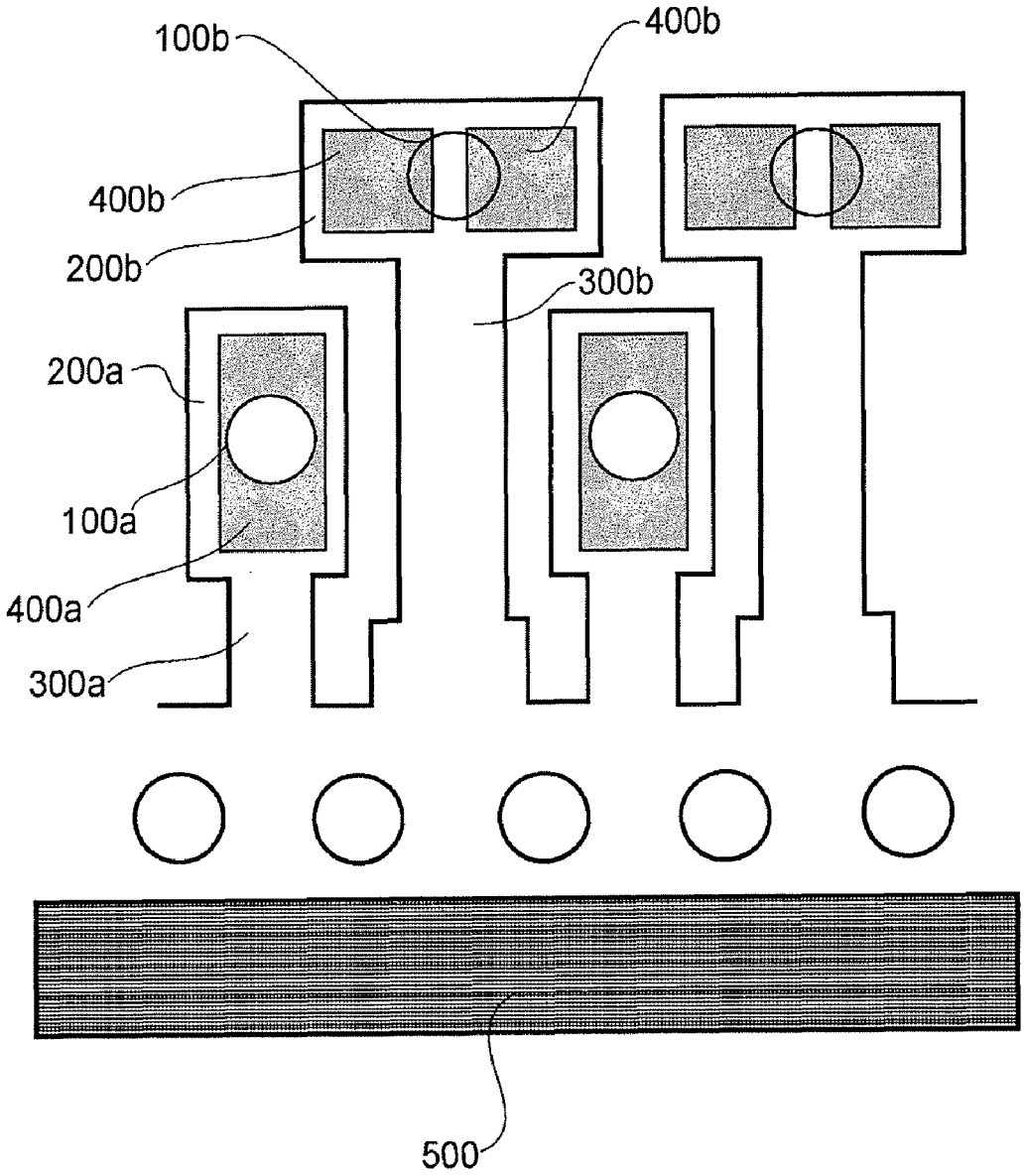
FIG. 3 is a schematic drawing of the nozzles in a part of the ink jet recording head in the second preferred embodiment.

FIG. 3 is a plan view of a portion of the ink jet recording head chip in the second embodiment of the present invention, showing its nozzle structure. This embodiment is similar to the first embodiment in that one end of each ink passage 300*a* is connected to the corresponding pressure chamber 200*a*, whereas the other end is connected to the common ink delivery channel 500, and also, in that one end of each ink passage 300*b* is connected to the corresponding pressure chamber 200*b*, whereas the other end is connected to the common ink delivery channel 500. Referring to FIG. 3, the ink jet recording head in this embodiment has multiple first ink jetting orifices 100*a*, which are relatively small in the distance from the common ink delivery channel 500, and multiple second ink jetting orifices 100*b*, which are relatively large in the distance from the common ink delivery channel 500. The first orifices 100*a* are aligned in a single straight row parallel to the lengthwise direction of the common ink delivery channel 500, and the second orifices 100*b* are also aligned in a single straight row parallel to the lengthwise direction of the common ink delivery channel 500, with the second orifices 100*b* offset from the corresponding first orifices 100*a* in the lengthwise direction of the common ink delivery channel 500. Thus, in terms of the lengthwise direction of the common ink delivery channel 500, the orifices 100 of this ink jet recording head are arranged in a zigzag pattern (staggered). Also in this embodiment, the ink jet recording head is provided with multiple first heaters 400*a* which oppose the first orifices 100*a*, one for one, and multiple second heaters 400*b* which oppose the second orifices 100*b*, one for one.

The ink jet recording head chip is structured so that, in terms of the direction parallel to the long edges of the common ink delivery channel 500, the width of the portion of each ink passage 300*b* (ink passage of relatively long nozzle), which is between the adjacent two first heaters 400*a*, is no more than the measurement of the short edges of the heat generating resistor of each first heater 400*a*.

Referring to FIG. 3, in terms of the nozzle row direction, the orifice pitch of the row of long nozzles and the orifice pitch of the row of short nozzles are 600 orifices per inch (42.3 μm in interval), as in the first embodiment. Thus, the combination of the row of first orifices 100*a* and the row of second orifices 100*b* can achieve an image resolution as high as 1,200 dpi. Incidentally, the ink jet recording head chip is also provided with another set of rows of ink jetting orifices 100, which is on the opposite side of the common ink delivery channel 500 from the first set, and the orifices 100 of this set are also offset in the lengthwise direction from the corresponding orifices 100 in the first set. Thus, the ink jet recording head in this embodiment can achieve a resolution as high as 2,400 dpi.

A first heater 400*a* (first recording element), which is relatively small in the distance from the common ink delivery channel 500, is rectangular, and is 13 μm×26 μm in measurement. A first orifice 100*a*, which is relatively small in the distance from the common ink delivery channel 500, is 10 μm-15 μm in diameter.

A second heater 400*b*, that is, the heater which is relatively large in the distance from the common ink delivery channel 500, is made up of two square heat generating resistors, which are 13 μm×13 μm in measurement. They are juxtaposed in parallel. The distance between the two resistors is roughly 2 μm-4 μm.

This embodiment is different from the first embodiment in that a second orifice 100*b*, that is, the orifice which is relatively large in the distance from the common ink delivery channel 500, is the same in diameter as that of a first orifice 100*a*, that is, the orifice which is relatively small in the distance from the common ink delivery channel 500, which is 10 μm-15 μm. In other words, this embodiment is different from the first embodiment in that the orifice pitch is improved while keeping the short and long nozzles practically the same in the amount by which liquid (ink) is jetted per jetting. In this embodiment, therefore, not only is a first orifice 100*a* the same in diameter as a second orifice 100*b*, but also, a first heater 400*a* is the same in the overall size of the heat generating portion as a second heater 400*b*.

The clearance between the wall of the pressure chamber 200*a* and the heater 400*a*, and the clearance between the wall of the pressure chamber 200*b* and the heater 400*b*, are roughly 2 μm. The distance from the common ink delivery channel 500 to a heater which is relatively short in the distance from the common ink delivery channel 500 is roughly 44 μm, and the distance between the center of a first heater 400*a* and the center of the adjacent second heater 400*b* is 35 μm-45 μm.

As described above, in this embodiment, even a long nozzle, that is, the nozzle whose ink jetting orifice is relatively farther from the common ink delivery channel 500, is significantly shorter in the length of its ink passage than the counterpart in the first embodiment. Therefore, the ink jet recording head in this embodiment is significantly shorter in the refill time, being thereby capable of printing at a significantly higher speed. In other words, this embodiment can also minimize the first problem, that is, the problem concerning the refill time. Therefore, the ink jet recording head in this embodiment can print at a significantly greater speed than an ink jet recording head in accordance with the prior art. Further, the ink jet recording head chip in this embodiment is significantly smaller in the size of the dead zone, that is, the portion of the pressure chamber, which is on the opposite side of the heater from the ink passage, and through which ink is unlikely to flow. Therefore, the second problem, that is, the problem that an ink jet recording head is made unstable in ink jetting performance by the air bubbles which become stagnant in the dead zone, does not occur.

Further, in terms of the lengthwise direction of heaters, the dimension of a first heater 400*a*, that is, the heater which is relatively small in the distance from the common ink delivery channel 500, is twice the dimension of a second heater 400*b*, that is, the heater which is relatively large in the distance from the common ink delivery channel 500. Therefore, the first and second heaters 400*a* and 400*b* can be driven by a single (common) electric power source, eliminating therefore the need for an additional electric power source. Therefore, the fourth problem, that is, the problem concerning the increase in the electric power manufacturing cost, is eliminated by this embodiment; this embodiment is effective to reduce an ink jet recording head chip in manufacturing cost.

The wiring for the heaters 400*a* and 400*b* on the substrate in this embodiment is the same as that in the first embodiment, which is shown in FIGS. 5 and 8. Therefore, it will not be described here. Further, the structure of the circuit is the same as that in the first embodiment, which is shown in FIG. 9. Therefore, it will not be described here.

Figure 6:
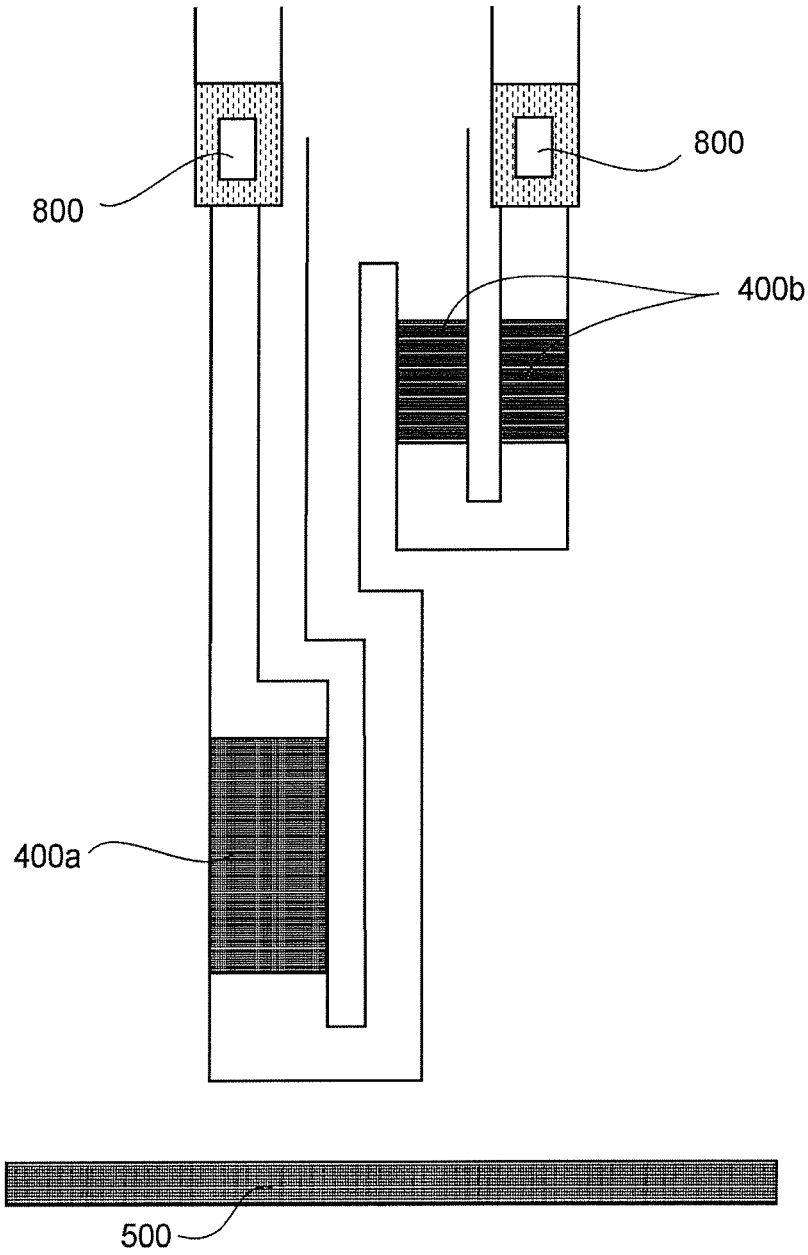
FIG. 6 is a schematic drawing of another example of the wiring for the ink jet recording heads in the first and second preferred embodiments.

Incidentally, the structural arrangement in this embodiment, which was described above, is not intended to limit the present invention in scope. For example, the present invention is applicable to an ink jet recording head chip which is wired as shown in FIG. 6. Wiring such as the one shown in FIG. 6 is possible by narrowing the wires of the wiring as much as possible in accordance with the structural requirements. With the employment of the structural arrangement shown in FIG. 6, the above described problems can be solved as the structural arrangement shown in FIG. 5 can.

Embodiment 3

Figure 4:
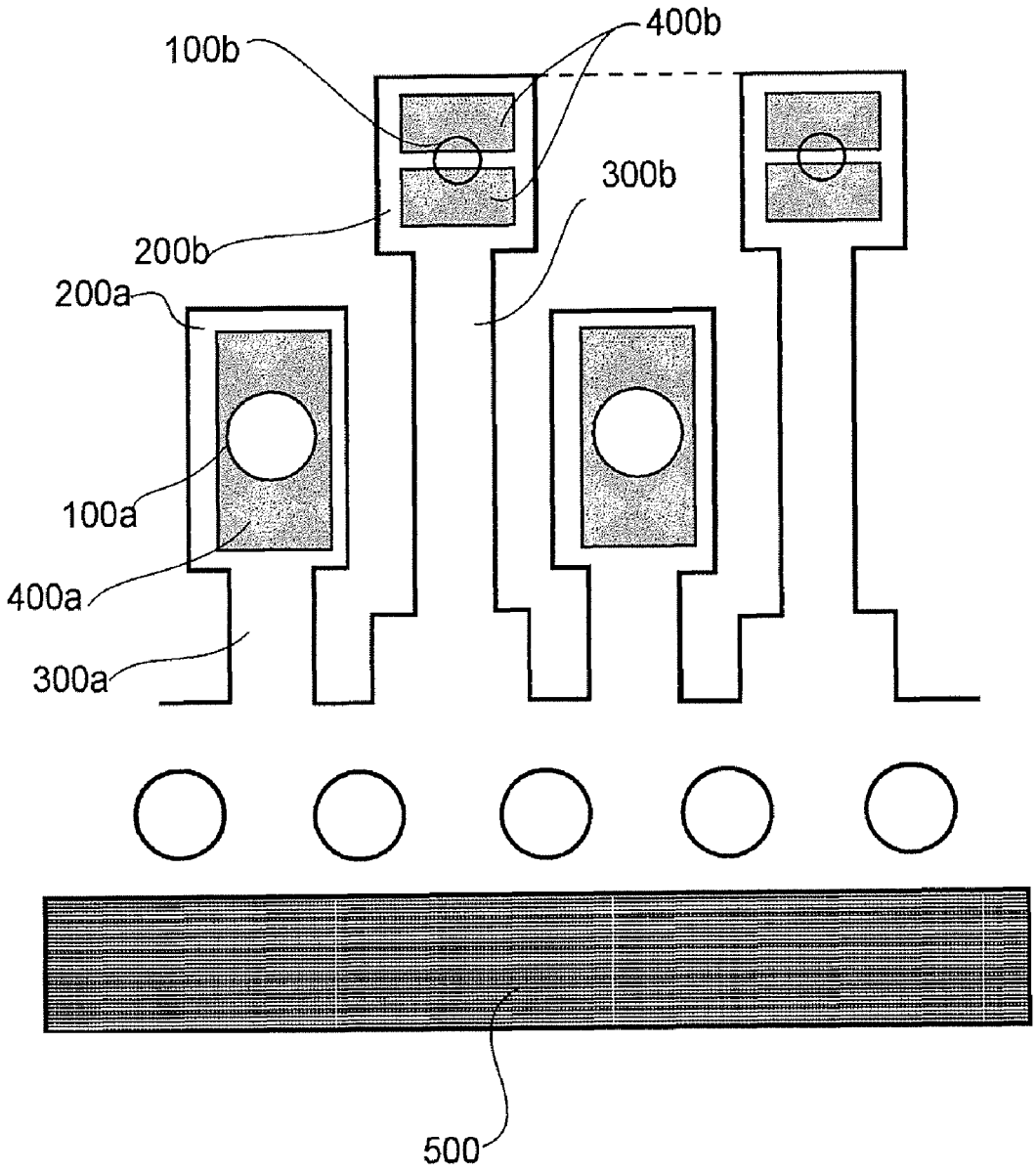
FIG. 4 is a schematic drawing of the nozzles in a part of the ink jet recording head in the third preferred embodiment.

FIG. 4 is a plan view of the ink jet recording head in the third embodiment of the present invention, showing its nozzle structure. One end of each ink passage 300*a* is connected to the corresponding pressure chamber 200*a*, whereas the other end is connected to the common ink delivery channel 500. Also, one end of each ink passage 300*b* is connected to the corresponding pressure chamber 200*b*, whereas the other end is connected to the common ink delivery channel 500. Referring to FIG. 4, the ink jet recording head chip in this embodiment has multiple first ink jetting orifices 100*a*, which are relatively small in the distance from the common ink delivery channel 500, and multiple second ink jetting orifices 100*b*, which are relatively large in the distance from the common ink delivery channel 500. The first orifices 100*a* are aligned in a single straight row parallel to the lengthwise direction of the common ink delivery channel 500, and the second orifices 100*b* are also aligned in a single straight row parallel to the lengthwise direction of the common ink delivery channel 500, with the second orifices 100*b* offset relative to the corresponding first orifices 100*a* in the lengthwise direction of the common ink delivery channel 500. Thus, in terms of the lengthwise direction of the common ink delivery channel 500, the orifices 100 of this ink jet recording head are arranged in a zigzag pattern. Also in this embodiment, the ink jet recording head chip is provided with multiple first heaters 400*a* which oppose the first orifices 100*a*, one for one, and multiple second heaters 400*b* which oppose the second orifices 100*b*, one for one.

Referring to FIG. 4, in terms of the direction parallel to the rows of ink jetting orifices, the orifice pitch of the row of long nozzles and the orifice pitch of the row of short nozzles are 600 orifices per inch (42.3 μm in interval), as in the first embodiment. Thus, the combination of the row of first orifices 100*a* and the row of second orifices 100*b* can achieve an image resolution of 1,200 dpi. Incidentally, the ink jet recording head chip is also provided with another set of rows of ink jetting orifices 100, which is on the opposite side of the common ink delivery channel 500 from the first set, and the orifices 100 of this set are offset in the lengthwise direction from the corresponding orifices 100 in the first set, also as in the first embodiment. Thus, the ink jet recording head in this embodiment can achieve an image resolution as high as 2,400 dpi.

A first heater 400*a* (first recording element), which is relatively small in the distance from the common ink delivery channel 500, is rectangular, and is 13 μm×26 μm in measurement. A first orifice 100*a*, which is relatively small in the distance from the common ink delivery channel 500, is 10 μm-15 μm in diameter.

A second heater 400*b*, that is, a heater which is relatively large in the distance from the common ink delivery channel 500, is made up of two rectangular heat generating resistors, which are 7 μm×13.5 μm in measurement. They are juxtaposed in parallel so that one of the long edges of one of the resistors faces one of the long edges of the other resistor. The distance between the two resistors is roughly 2 μm-4 μm.

As for the measurements of an ink passage 300*b*, that is, an ink passage which is relatively long, the portion of the ink passage 300*b*, which is between the adjacent two first heaters 400*a*, is smaller in width than the actual heat generating resistor portion of the first heater 400*a*, in terms of the direction parallel to the long edges of the common ink delivery channel 500.

This embodiment is different from the first embodiment in that a second orifice 100*b*, that is, the orifice which is relatively large in the distance from the common ink delivery channel 500, is substantially smaller in diameter (3 μm-7 μm) than the counterpart in the first embodiment. Thus, the ink jet recording head in this embodiment can jet liquid droplets smaller than the smallest liquid droplets which the ink jet recording head in the first embodiment can jet. In other words, this embodiment is suitable for achieving more levels of tone than the levels of tone achievable by the first embodiment. In this embodiment, therefore, for the purpose of making it possible to make first and second orifices 100*a* and 100*b* different in the liquid droplets they jet, not only are the first and second orifices 100*a* and 100*b* made different in diameter, but also, first and second heaters 400*a* and 400*b* are made different in the overall size of the effective heat generating areas.

Also, this embodiment is different from the first embodiment in that the lengthwise direction of a heater 400*b*, that is, the heater which is relatively long in the distance from the common ink delivery channel 500, has an angle of 90° relative to the lengthwise direction of an ink passage 300*b*. Further, for the purpose of ensuring that when an ink droplet is jetted out of an ink jetting orifice, it cleanly separates from the body of ink in the orifice, the ink jet recording head chip in this embodiment is structured to be effective to block the ink flow from the ink passage 300 during the jetting of an ink droplet from the orifice.

The clearance between the wall of the pressure chamber 200*a* and the heater 400*a*, and the clearance between the wall of the pressure chamber 200*b* and the heater 400*b*, are roughly 2 μm, as in the first embodiment. The distance from the common ink delivery channel 500 to a first heater 400*a*, that is, the heater which is relatively small in the distance from the common ink delivery channel 500 is roughly 44 μm, and the distance between the center of a first heater 400*a* and the center of the adjacent second heater 400*b* is 35 μm-45 μm.

As described above, in this embodiment, even a long nozzle, that is, the nozzle whose ink jetting orifice is relatively farther from the common ink delivery channel 500, is significantly shorter in the length of its ink passage than the counterpart in the first embodiment. Therefore, the ink jet recording head in this embodiment is significantly shorter in refill time, being thereby capable of printing at a significantly higher speed than an ink jet recording head in accordance with the prior art. In other words, this embodiment also can minimize the problem concerning the refill time. That is, the refill time of the ink jet recording head in this embodiment is even more significantly shorter than that of an ink jet recording head in accordance with the prior art. Therefore, the ink jet recording head in this embodiment can print at an even more significantly greater speed than an ink jet recording head in accordance with the prior art. Further, the ink jet recording head chip in this embodiment is significantly smaller in the size of the dead zone, that is, the portion of the pressure chamber, which is on the opposite side of the heater from the ink passage, and through which ink is unlikely to flow. Therefore, the second problem, that is, the problem that an ink jet recording head is made unstable in ink jetting performance by the air bubbles which become stagnant in the dead zone, does not occur.

Further, the lengthwise dimension of a first heater 400*a*, that is, the heater which is relatively small in the distance from the common ink delivery channel 500, is twice that of a second heater 400*b*, that is, the heater which is relatively large in the distance from the common ink delivery channel 500. Therefore, the first and second heaters 400*a* and 400*b* can be driven by a single (common) electric power source, eliminating therefore the need for an additional electric power source. Thus, this embodiment eliminates the fourth problem, that is, the problem concerning the increase in the electric power manufacturing cost; this embodiment is effective to reduce an ink jet recording head chip in manufacturing cost.

Figure 7:
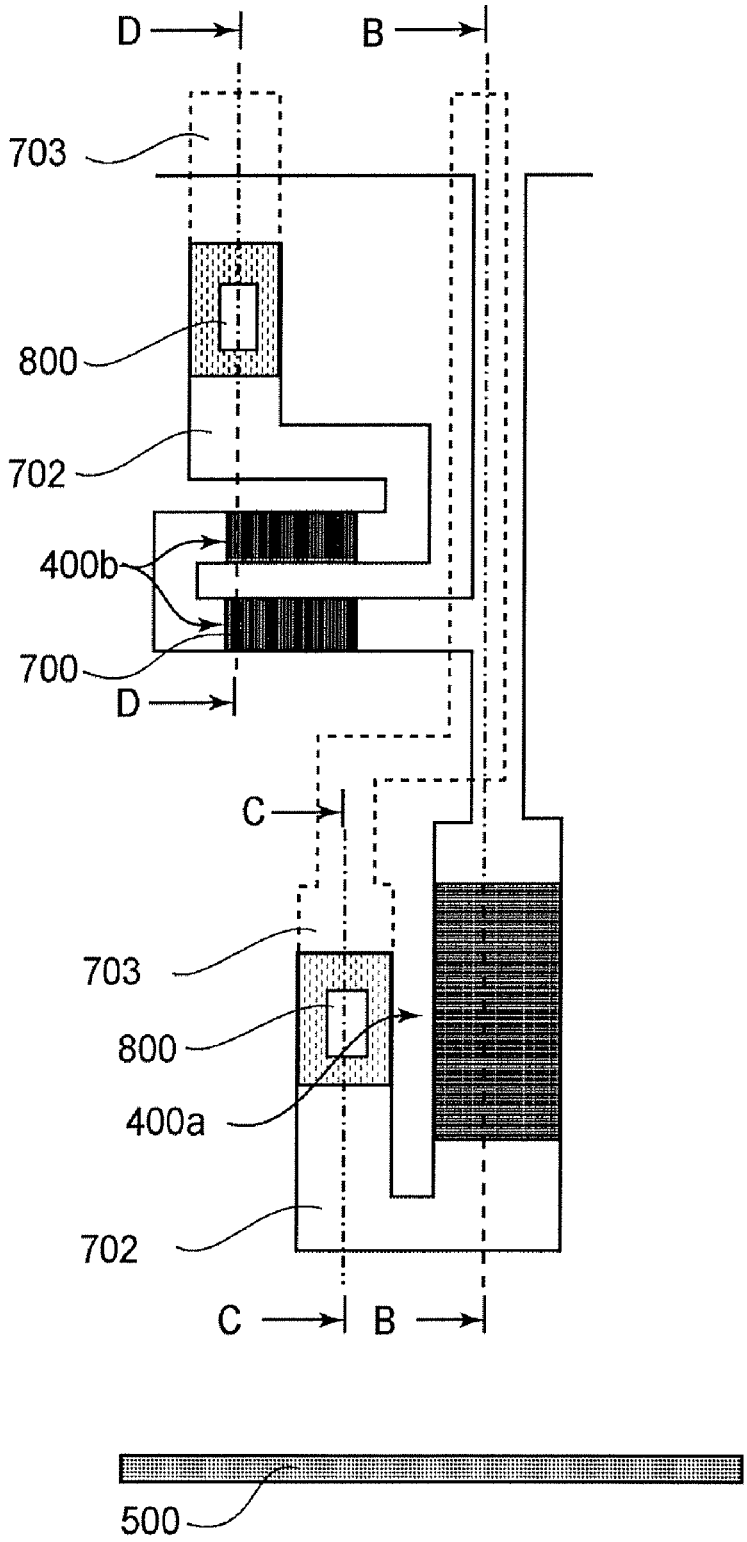
FIG. 7 is a schematic of the wiring of the ink jet recording head chip in the third preferred embodiment.

FIG. 7 is a schematic drawing of the wiring for the heaters 400*a* and 400*b* structured on the substrate as described above. FIGS. 8(*b*)-8(*d*) are schematic sectional views of the ink jet recording head chips in this embodiment, which correspond to lines B-B, C-C, and D-D, respectively, in FIG. 7.

The laminar structure of the ink jet recording head chip in this embodiment is the same as that in the first embodiment, as shown in FIGS. 8(*b*)-8(*d*).

Referring to FIG. 7, a first heater 400*a*, or the heater which is relatively small in the distance from the common ink delivery channel 500, is in electrical connection with the first and second wiring layers 703 and 702, that is, the top and bottom wiring layers, respectively, through the through hole 800 provided next to the heater 400*a*, as it is in the first embodiment. Further, the areas of the heater layer 700, on which the first and second wiring layers 703 and 702 are not present, correspond to the first and second heaters 400*a* and 400*b*.

Also as in the first embodiment, the second wiring layer 702 is not present directly below the first and second heaters 400*a* and 400*b*, making it unlikely for the heat dispersion, and the stepped portion of the nozzle plate attributable to the stepped portions of the substrate, to have adverse effects. Further, the through hole 800 is located in the adjacencies of the first and second heaters 400*a* and 400*b*. Therefore, the ink jet recording head chip in this embodiment is excellent in area (space) utilization efficiency. Further, the through hole 800 is positioned at the mid point between the adjacent two heaters 400*a*, making it unlikely for the stepped portions of the nozzle plate attributable to the through holes 800 to have adverse effects.

This embodiment is different from the preceding embodiments in that the pattern of the wiring for a second heater 400*b*, that is, the heater which is relatively large in the distance from the common ink delivery channel 500, is different from those in the preceding embodiments. More specifically, in this embodiment, the lengthwise direction of the two heat generating resistors of a second heater 400*b*, that is, the heater which is relatively large in the distance from the common ink delivery channel 500, is perpendicular (having an angle of 90°) to the lengthwise direction of the common ink delivery channel 500. Thus, the wiring for the heaters 400 has to be more intricate than that in the preceding embodiments. More concretely, a portion of the second wiring layer 702, which is for the heater 400*b* in this embodiment, is bent in the form a letter S as shown in FIG. 7.

As described above, also in this embodiment, by employing the structural arrangement described above, the chip components can be efficiently laid out from the standpoint of space utilization efficiency. Thus, this embodiment can solve the third problem, that is, the problem that the manufacturing cost for an ink jet recording head chip is increased by the increase in the substrate size.

The circuit structure in this embodiment is the same as that in the first embodiment, which is shown in FIG. 9. Therefore, it will not be described here.

Lastly, a typical ink jet printer having one of the above described ink jet recording heads will be briefly described.

<General Structure of Ink Jet Printer>

Figure 10:
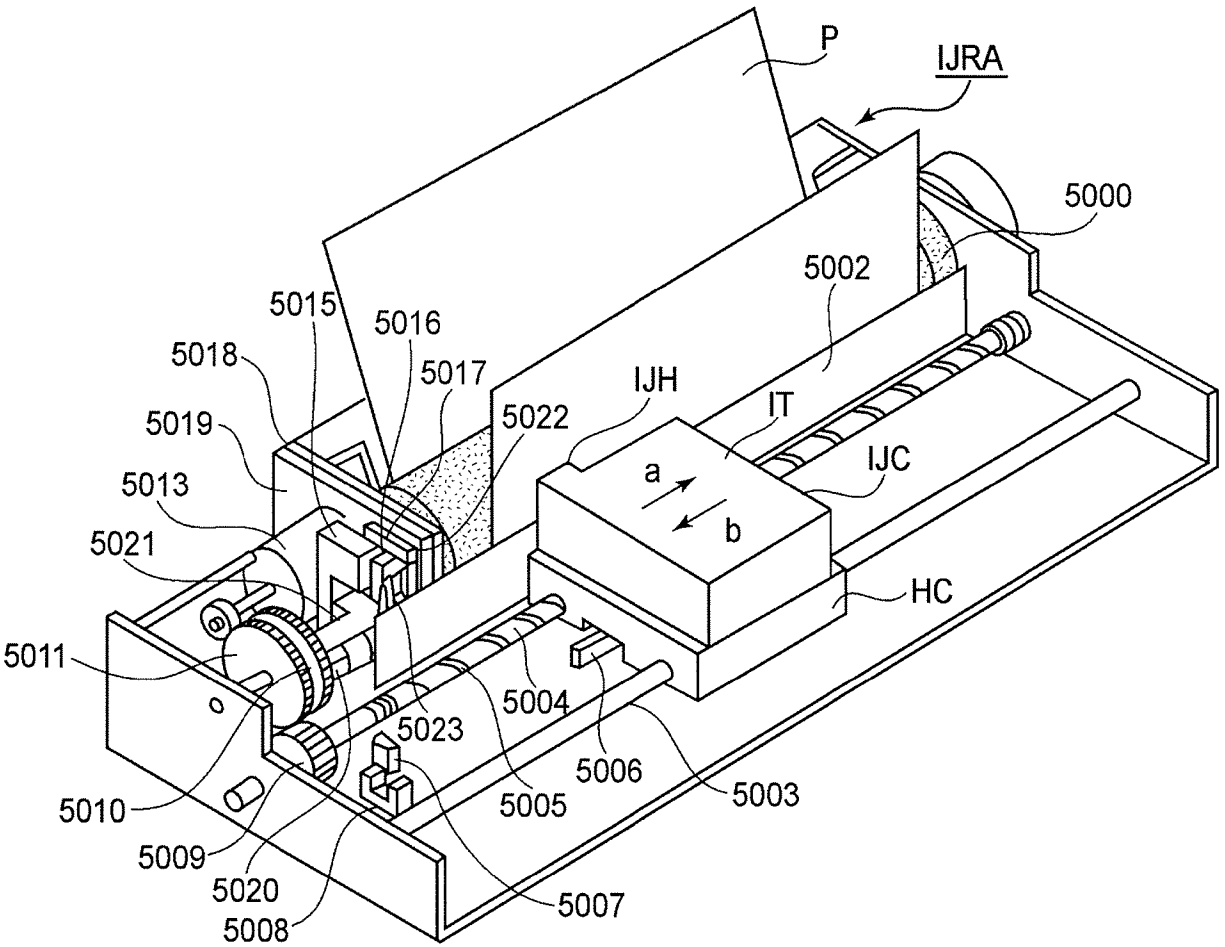
FIG. 10 is a perspective view of a typical ink jet printer in accordance with the present invention.

FIG. 10 is an external perspective view of a typical ink jet printer IJRA in accordance with the present invention, showing the general structure of the printer.

Referring to FIG. 10, a carriage HC is supported by a lead screw 5004 and a guide rail 5003. The lead screw 5004 is rotated by a motor 5013 through driving force transmission gears 5009-5011. The motor 5013 is reversible in rotational direction. Thus, as the motor 5013 is driving forward or in reverse, the carriage HC reciprocally moves; it moves in the direction indicated by an arrow mark a or b. The carriage HC has a pin (unshown) which is in engagement with the spiral groove 5005 of the lead screw 5004. The carriage HC holds an ink jet cartridge IJC, which is an integral combination of an ink jet recording head IJH and an ink container IT.

A paper pressing plate 5002 keeps a sheet of recording paper P pressed against a platen 5000 across its entire range in terms of the moving direction of the carriage HC. A photocoupler 5007-5008 is a detector for detecting whether or not the carriage HC is in its home position. More specifically, as the photo coupler 5007-5008 detects the presence of lever 5006 of the carriage HC between the portions 5007 and 5008, it determines that the carriage HC is in its home position. The motor 5013 is switched in rotational direction as it is detected that the carriage HC is in the home position. A capping member 5022 for capping the front side of the recording head IJH is supported by a supporting member 5016. A vacuuming device 5015, which is for vacuuming the inside of the capping member 5022, restores the recording head IJH in performance by suctioning out the liquid (ink) in the recording head IJH through the opening 5023 of the capping member 5022. A cleaning blade 5017 and a cleaning blade moving member 5019 for moving the cleaning blade 5017 forward or backward are supported by a supporting plate 5018 attached to the main frame of the ink jet printer. The structure for the cleaning blade 5017 does not need to be limited to the above described one. That is, any of the well-known cleaning blades is usable with the ink jet printer in accordance with the present invention, which is obvious. A lever 5021, which is for starting the suctioning of the ink jet recording head to restore the performance of the ink jet recording head, is moved by the movement of a cam 5020, which engages with the carriage HC. The movement of the lever 5021 engages or disengages a known mechanical force transmitting means, such as a clutch, to control the transmission of the driving force from a motor to the means for restoring the performance of the ink jet recording head.

The ink jet printer is structured so that the capping operation, cleaning operation, and head performance restoring operation are carried out while the carriage HC is in the adjacencies of its home position; the carriage HC (ink jet recording head) is positioned where each of the abovementioned operations is to be performed, by the rotation of the lead screw 5004, so that the desired operation can be performed. Incidentally, the structural arrangement for performing the abovementioned three operations does not need to be limited to the above described one, as long as any of the three operations can be performed with well known timing.

<Structure of Control System>

Next, the structure of the control system for controlling the recording operation of the above described ink jet printer will be described.

Figure 11:
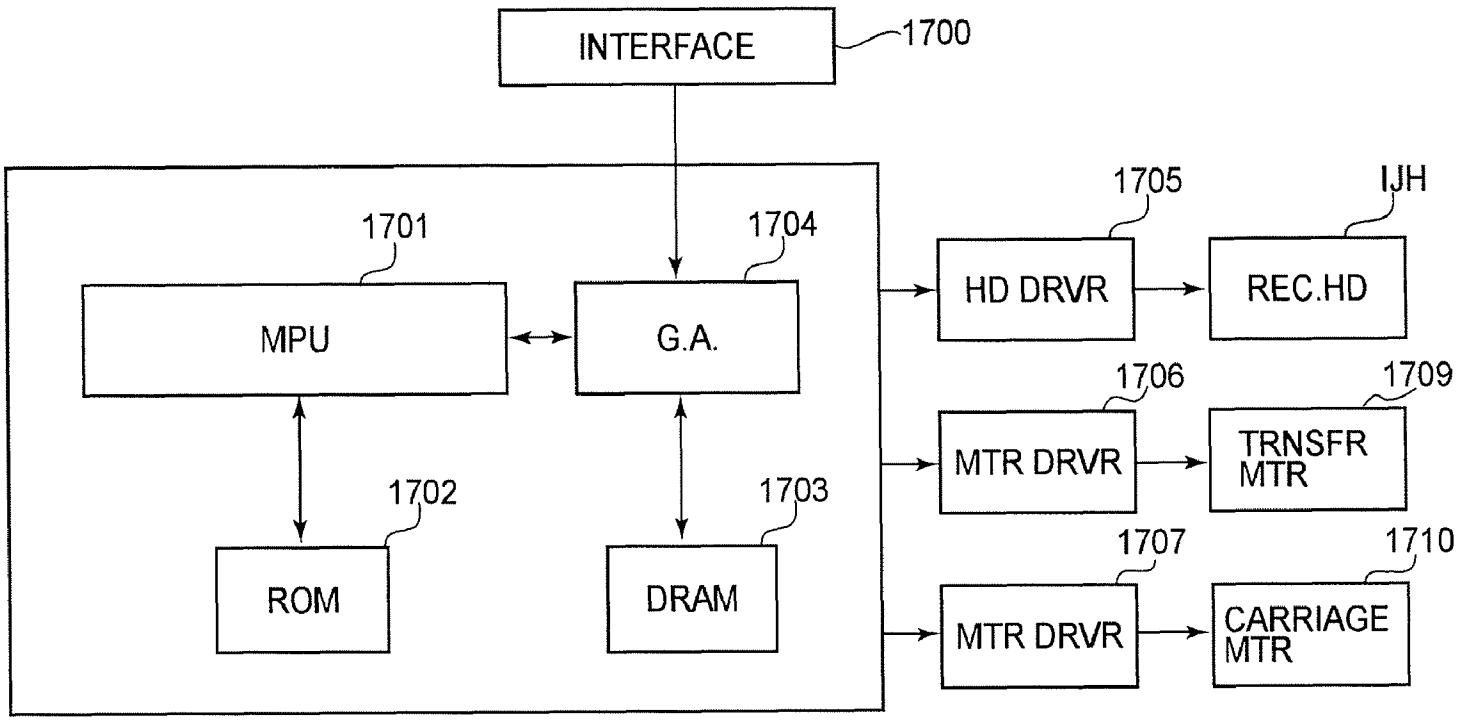
FIG. 11 is a block diagram of the control circuit of the abovementioned ink jet printers.
Figure 12:
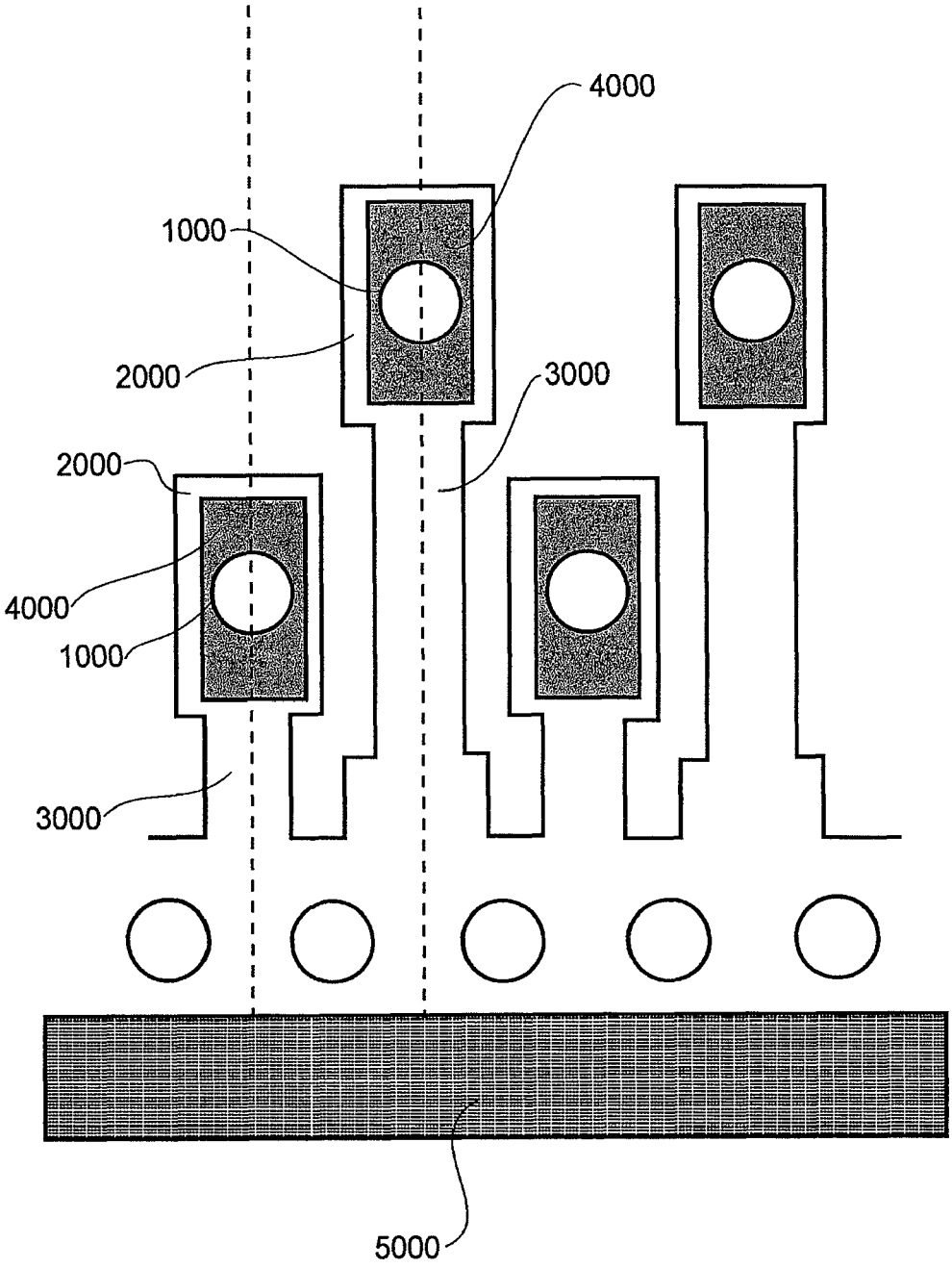
FIG.12 PRIOR ART
FIG. 12 is a schematic drawing of the sections of the nozzle rows of a typical conventional ink jet recording head.

FIG. 11 is a block diagram of the control circuit of the ink jet printer IJRA, and shows the structure of the circuit. Referring to FIG. 11, the control circuit has an interface 1700 through which recording signals are inputted, and an MPU 1701 as a logic circuit. The control circuit also has: a ROM 1702 in which the control programs carried out by the MPU 1701 are stored; and a DRAM 1703 in which various data (recording signals, recording data, etc., which are supplied to recording head IJH) are stored. The control circuit also has a gate array (G.A.) 1704, which controls the process of supplying the recording head IJH with recording data. The gate array 1704 also controls the data transfer among the interface 1700, MPU 1701, and RAM 1703.

The control circuit drives the recording head IJH. More specifically, it controls the recording head IJH by controlling a head driver 1705, which switches the state of a recording element between the state in which electric current is flowing through the recording element and the state in which electric current is not flowing through the recording element. It also controls a carriage motor for moving the carriage HC to move the recording head IJH, and a recording sheet conveyance motor 1709 for conveying sheets of recording paper, by controlling a motor driver 1707 for driving the carriage motor 1710, and a motor driver 1706 for driving the recording sheet conveyance motor 1709, respectively.

To describe the processes controlled by the control circuit, as recording signals are inputted through the interface 1700, they are converted into recording data for printer, through the coordination between the gage array 1704 and MPU 1701. Then, the motor drivers 1706 and 1707 are driven, and also, the recording head IJH is driven, based on the recording data outputted to the head driver 1705. As a result, recording is made on a sheet of recording paper.

Next, the ink jet recording head IJH will be described. The present invention is compatible with various ink jet recording heads, in particular, ink jet recording heads which have a means for generating the thermal energy for changing the liquid ink in phase to jet the liquid ink. The employment of this method of jetting liquid ink with the use of thermal energy by an ink jet recording head makes it possible for the ink jet recording head to record letters and pictographic images at a significantly higher resolution and a higher level of precision than an ink jet recording head employing an ink jet recording method other than the above described one. In the preceding preferred embodiments of the present invention, an electro-thermal transducer is used as the means for generating thermal energy, and the liquid ink was heated by the electro-thermal transducer to jet the ink by utilizing the pressure generated by the bubbles generated as the ink is boiled by the heat.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 230449/2006 filed Aug. 28, 2006, which is hereby incorporated by reference herein.

What is claimed is:

1. A liquid ejection head comprising:

a plurality of ejection outlets for ejecting droplets;

liquid flow paths in fluid communication with said ejection outlets;

a liquid supply opening for supplying the liquid to said liquid flow paths, wherein said ejection outlets include first ejection outlets and second ejection outlets which are disposed at least at one side of said liquid supply opening, wherein said first ejection outlets are nearer to said liquid supply opening than said second ejection outlets, and said first ejection outlets and said second ejection outlets are arranged in a staggered fashion;

first recording elements corresponding to said first ejection outlets; and second recording elements corresponding to said second ejection outlets, wherein each of said first recording elements comprises one heat generating resistor in the form of a rectangular shape having a long side extending along a direction crossing with an arranging direction of said ejection outlets, wherein each of said second recording elements comprises a plurality of heat generating resistors, each of which is in the form of a rectangular shape, and which are adjacent to each other at long sides thereof, said plurality of heat generating resistors forming each of said second recording elements being electrically connected in series, wherein wiring leads for supplying electric power to said first recording elements and said second recording elements are connected to short sides of said heat generating resistors, and wherein the number of said second recording elements comprising each of said second recording elements is two the long side of each of said heat generating resistors of comprising said first recording elements has a length which is about twice a length of the long side of each of said heat generating resistors comprising said second recording elements.

2. A liquid ejection head according to claim 1, wherein an ejection amount of the liquid droplet ejected from one of said second ejection outlets is smaller than an ejection amount of the liquid droplet ejected from one of said first ejection outlets.

3. A liquid ejection head according to claim 1, wherein each of said first ejection outlets and said second ejection outlet outlets eject substantially the same amounts of the liquid.

4. A liquid ejection head according to claim 1, wherein a sum of lengths of short sides of said two heat generating resistors comprising each of said second recording elements and a gap between said two heat generating resistors is not less than one half of an arranging pitch of said second ejection outlets.

5. A liquid ejection head according to claim 1, further comprising electric power supplying means for supplying driving voltages to said recording elements, a driver, provided for each of said recording elements, for switching an electric power supply state for said recording element, and a logic circuit for selectively driving said driver, wherein said electric power supplying means supplies the driving voltage to the first and second recording elements.

6. A liquid ejection head according to claim 1, further comprising electric power supplying means for supplying driving voltages to said recording elements, a driver, provided for each of said recording elements, for switching an electric power supply state for said recording element, and a logic circuit for selectively driving said driver, wherein said logic circuit includes drive time determination signal outputting means for outputting to said driver a signal related to a drive time of said recording element, and said drive time determination signal outputting means is common to said first and second recording elements.

7. A liquid ejection head comprising:

a plurality of ejection outlets for ejecting droplets;

liquid flow paths in fluid communication with said ejection outlets;

a liquid supply opening for supplying the liquid to said liquid flow paths, wherein said ejection outlets include first ejection outlets and second ejection outlets which are disposed at least at one side of said liquid supply opening, wherein said first ejection outlets are nearer to said liquid supply opening than said second ejection outlets, and said first ejection outlets and said second ejection outlets are arranged in a staggered fashion;

first recording elements corresponding to said first ejection outlets; and second recording elements corresponding to said second ejection outlets, wherein each of said first recording elements comprises one heat generating resistor in the form of a rectangular shape having a long side extending along a direction crossing with an arranging direction of said ejection outlets, wherein each of said second recording elements comprises a plurality of heat generating resistors, each of which is in the form of a rectangular shape, and which are adjacent to each other at long sides thereof, said plurality of heat generating resistors forming each of said second recording elements being electrically connected in series, and wherein said liquid flow paths include first liquid flow paths corresponding to said first recording elements and second liquid flow paths corresponding to said second recording elements, and wherein each of said second liquid flow paths has a width measured in a direction parallel with an arranging direction of said ejection outlets, the width being not more than a length of a short side of each of said heat generating resistors of comprising said first recording elements.

8. A liquid ejection head comprising:

a plurality of ejection outlets for ejecting droplets;

liquid flow paths in fluid communication with said ejection outlets;

a liquid supply opening for supplying the liquid to said liquid flow paths, wherein said ejection outlets include first ejection outlets and second ejection outlets which are disposed at least at one side of said liquid supply opening, wherein said first ejection outlets are nearer to said liquid supply opening than said second ejection outlets, and said first ejection outlets and said second ejection outlets are arranged in a staggered fashion;

first recording elements corresponding to said first ejection outlets; and second recording elements corresponding to said second ejection outlets, wherein each of said first recording elements comprises one heat generating resistor in the form of a rectangular shape having a long side extending along a direction crossing with an arranging direction of said ejection outlets, wherein each of said second recording elements comprises a plurality of heat generating resistors, each of which is in the form of a rectangular shape, and which are adjacent to each other at long sides thereof, said plurality of heat generating resistors forming each of said second recording elements being electrically connected in series, and wherein a wiring lead for supplying electric power to each of said first recording elements includes upper and lower wiring layers which are electrically connected to each other through a through-hole provided adjacent to said heat generating resistor comprising one of said first recording elements.

9. A liquid ejection head according to claim 8, wherein each of the lower wiring layers is not in contact with a resistor layer constituting a corresponding one of said heat generating resistors and is disposed at a location other than right below said first recording element.

10. A liquid ejection head according to claim 8, wherein each through-hole is disposed between adjacent ones of said first recording elements.

11. A liquid ejection head according to claim 10, wherein each through-hole has a center at a position substantially in line with centers of said first recording elements.

* * * * *